US008149170B2

(12) United States Patent
Burke et al.

(10) Patent No.: US 8,149,170 B2
(45) Date of Patent: Apr. 3, 2012

(54) CARBON NANOTUBE BASED VARIABLE FREQUENCY PATCH-ANTENNA

(75) Inventors: Peter J. Burke, Irvine, CA (US); Christopher Rutherglen, Tustin, CA (US)

(73) Assignee: The Regents of the University of California, oakland, CA (US)

( * ) Notice: Subject to any disclaimer, the term of this patent is extended or adjusted under 35 U.S.C. 154(b) by 495 days.

(21) Appl. No.: 12/337,473

(22) Filed: Dec. 17, 2008

(65) Prior Publication Data

US 2009/0231205 A1 Sep. 17, 2009

Related U.S. Application Data

(60) Provisional application No. 61/014,112, filed on Dec. 17, 2007.

(51) Int. Cl.
*H01Q 1/38* (2006.01)

(52) U.S. Cl. ..... 343/700 MS; 343/848; 356/51

(58) Field of Classification Search ..... 343/700 MS, 343/848; 356/51
See application file for complete search history.

(56) References Cited

U.S. PATENT DOCUMENTS

2009/0294753 A1* 12/2009 Hauge et al. ..... 257/9
2011/0194100 A1* 8/2011 Thiel et al. ..... 356/51

OTHER PUBLICATIONS

Rutherglenet al., "Nanoelectromagnetics: Circuit and Electromagnetic Properties of Carbon Nanotubes," small 2009, 5, No. 8 (2009 Wiley VCH Verlag Cmbh & Co., KGaA, Weinheim), pp. 884-906.

* cited by examiner

*Primary Examiner* — Tan Ho
(74) *Attorney, Agent, or Firm* — Orrick, Herrington & Sutcliffe, LLP

(57) ABSTRACT

A carbon nano-tube based variable frequency patch antennas which utilizes a dense network of semiconducting carbon nanotubes as the antenna patch is provided. In preferred embodiments, the resonant frequency of the antenna can be tuned electrically by adjusting appropriate sections of its back-gate, thus altering the effective size of the patch antenna and radiation beam direction can be formed and stirred. In one embodiment, a patch antenna comprises a dense network or thick layer of semiconducting carbon nanotubes grown or deposited on an oxide layer to form a carbon nanotube patch and a partitioned backgate is positioned below the oxide layer with a ground-plane formed from a thin layer of metal. In other embodiments, a patch antenna includes an array of carbon nanotube patches and the ground-plane doubles as the backgate.

13 Claims, 4 Drawing Sheets

CARBON NANOTUBE BASED VARIABLE FREQUENCY PATCH-ANTENNA

CROSS-REFERENCE TO RELATED APPLICATIONS

This application claims the benefit of U.S. provisional application Ser. No. 61/014,112, filed Dec. 17, 2007, which is fully incorporated herein by reference.

This invention was made with government support under grant N00014-06-1-0268 awarded by the U.S. Office of Naval Research, and contract W911NF-07-C-0098 awarded by the U.S. Army Research Office. The government has certain rights in the invention.

FIELD OF THE INVENTION

The present invention relates to carbon nano-tubes and, more particularly, to carbon nano-tube based variable frequency patch-antennas.

BACKGROUND OF THE INVENTION

Conventional patch antennas embody a design that is well over 50 years old. Patch antennas are very popular because of the ease in which they can be fabricated, modified or customizes. Typically, a patch antenna includes a metal patch, such as a patch of copper, suspended over a ground plane. To protect the structure from damage, the assembly is usually encased in a plastic enclosure. Consequently, the size and, thus, frequency of the patch antenna is fixed at fabrication.

SUMMARY OF THE INVENTION

The various embodiments and examples provided herein are generally directed to carbon nano-tube based variable frequency patch antennas which utilize a dense network of semiconducting carbon nanotubes as the antenna patch as opposed to a metal patch. In preferred embodiments, the resonant frequency of the antenna can be tuned electrically by adjusting appropriate sections of its back-gate, thus altering the effective size of the patch antenna; radiation beam direction can be formed and stirred by judiciously biasing certain backgate electrodes or using a patch antenna array setup; and, depending on the thickness of the carbon nanotubes used and the substitution of metallic carbon nanotubes for the ground-plane, a transparent carbon nanotube-based patch antenna can be fabricated.

In one embodiment, a patch antenna comprises a dense network or thick layer of semiconducting carbon nanotubes grown or deposited on an oxide layer to form a carbon nanotube patch. A metal microstrip feedline is coupled to the patch. A partitioned backgate is positioned below the oxide layer on a top side of a substrate, such as quartz or the like. A ground-plane formed from a thin layer of metal is coupled to the bottom of the substrate. The effective length of this carbon nanotube patch can be adjusted by selectively gating different portions of the backgate partitioned beneath the oxide layer.

In another embodiment, a patch antenna includes an array of semiconducting carbon nanotube patches.

In another embodiment, the ground-plane doubles as the backgate of the patch antenna. The patch antenna preferably includes a carbon nanotube patch grown or deposited on a substrate such as an oxide layer, quartz or the like. A partitioned dense network or thick layer of semiconducting carbon nanotubes are grown or deposited on a bottom side of the substrate opposite the patch. The partitioned layer of carbon nanotubes doubles as a ground plane at RF and an apportioned back-gate at DC.

In yet another embodiment, the patch antenna could be incorporated in systems or devices for radar, communications, and the like. The patch antenna would be implemented by either customizing the controls within the intended device or work as an external unit that is capable itself of properly adjusting gate switches to obtain the intended frequency. Preferably, the system or device would include the patch antenna coupled to a transmitter/receiver and a gate switch box comprising a plurality of switch pairs each coupled to a separate gate of the patch antenna's partitioned backgate. A power supply comprising positive and negative voltages source is coupled to the gate switch box. A controller coupled to the gate switch box is used to selectively open and close each of the switches of the plurality of switch pairs to direct positive or negative voltages to each of the gates of the partitioned backgate to vary the frequency of the antenna and/or to form and steer radiation beams emitted from the antenna.

Other objects and features of the present invention will become apparent from consideration of the following description taken in conjunction with the accompanying drawings.

BRIEF DESCRIPTION OF THE FIGURES

The details of the invention, both as to its structure and operation, may be gleaned in part by study of the accompanying figures, in which like reference numerals refer to like parts. The components in the figures are not necessarily to scale, emphasis instead being placed upon illustrating the principles of the invention. Moreover, all illustrations are intended to convey concepts, where relative sizes, shapes and other detailed attributes may be illustrated schematically rather than literally or precisely.

DESCRIPTION OF THE PREFERRED EMBODIMENTS

Each of the features and teachings disclosed below can be utilized separately or in conjunction with other features and teachings to provide carbon nano-tube based variable frequency patch antennas. Representative examples of the present invention, which examples utilize many of these additional features and teachings both separately and in combination, will now be described in further detail with reference to the attached drawings. This detailed description is merely intended to teach a person of skill in the art further details for practicing preferred aspects of the present teachings and is not intended to limit the scope of the invention. Therefore, combinations of features and steps disclosed in the following detail description may not be necessary to practice the invention in the broadest sense, and are instead taught merely to particularly describe representative examples of the present teachings.

Moreover, the various features of the representative examples and the dependent claims may be combined in ways that are not specifically and explicitly enumerated in order to provide additional useful embodiments of the present teachings. In addition, it is expressly noted that all features disclosed in the description and/or the claims are intended to be disclosed separately and independently from each other for the purpose of original disclosure, as well as for the purpose of restricting the claimed subject matter independent of the compositions of the features in the embodiments and/or the claims. It is also expressly noted that all value ranges or indications of groups of entities disclose every possible intermediate value or intermediate entity for the purpose of original disclosure, as well as for the purpose of restricting the claimed subject matter.

The various embodiments provided herein are generally directed to carbon nano-tube based variable frequency patch antennas. A preferred embodiment comprises a dense network of semiconducting carbon nanotubes with a low sheet-resistance of a few ohms or less as the antenna patch as opposed to a metal. Although the physical size of the carbon nanotube patch is fixed, the effective size can be varied electrically by appropriate backgating which in affect turns on or off the conductance of these sections of the patch antenna. Consequently, an electrically controlled variable frequency patch-antenna can be achieved. In addition, the direction of radiation beams can be formed and steered electrically by appropriately gating the backgate.

Figure 1:
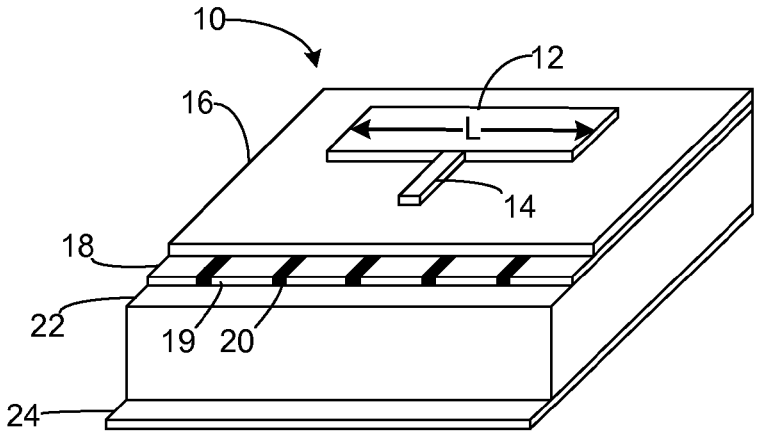
FIG. 1 is perspective views of a carbon nano-tube based variable frequency patch (aka microstrip) antenna.

Referring to FIG. 1, the basic patch antenna 10 comprises a dense network or thick layer of semiconducting carbon nanotubes 12, preferably having a thickness of greater than about 100 nm, are grown or deposited on an oxide layer 16, preferably having a thickness of about 30 nm, to form a carbon nanotube patch of physical length (L). Coupled to the patch 12 and deposited on the oxide layer 16 is a metal microstrip feedline 14. The oxide layer 16 is deposited or grown on a partitioned backgate 18 preferably having a thickness of about 10 nm and comprising metal gate electrodes 19 separated by dielectric partitions 20 formed of an oxide or the like. The partitioned backgate 18 is deposited or grown on a top side of a substrate 22, such as quartz or the like, preferably having a thickness of about 500 um. A ground-plane 24 formed from a thin layer of metal, preferably having a thickness of about 15 um, is coupled to the bottom of the substrate 22. Electrodes can be contacted to the gate electrodes 19 by etching away a portion of the oxide layer 16 as shown or, in the alternative, forming metal via through the oxide layer 16.

Figure 3A:
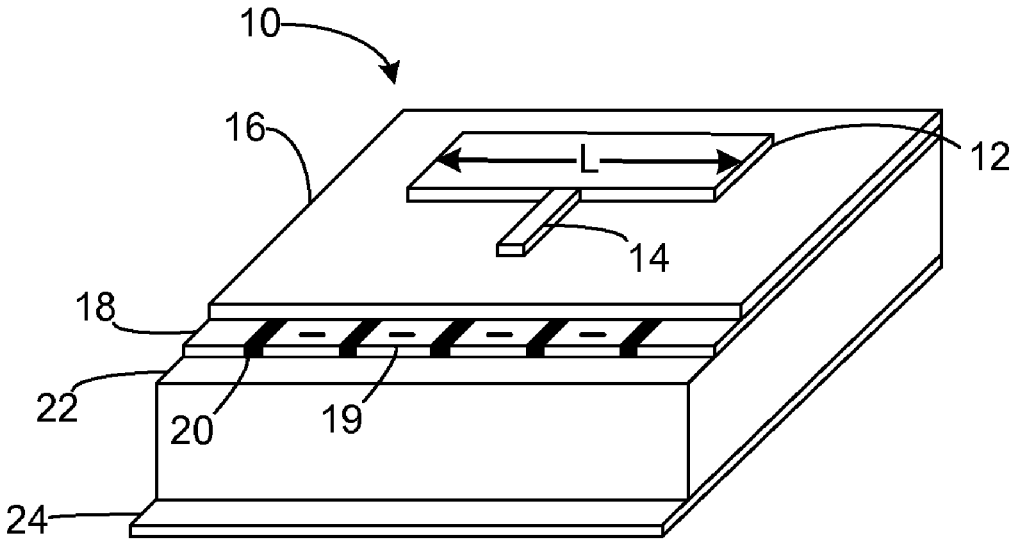
FIGS. 3A and 3B are perspective views of the patch antenna shown in FIG. 1 illustrating the effect altering the bias of the gate electrodes.
Figure 3B:
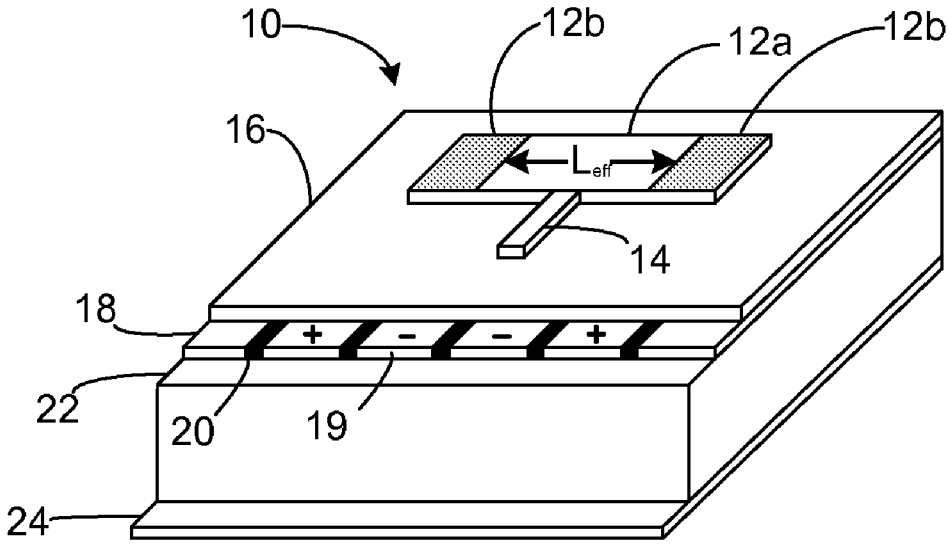

The effective length of this carbon nanotube patch 12 can be adjusted by selectively gating different portions of the backgate 18 partitioned beneath the oxide layer 16, as shown in FIGS. 3A and 3B. For example, to decrease the effective length of the patch 12, back-gates 18 immediately beneath the extremes of the patch 12 can be charged with a large positive voltage there-by drastically decreasing the conductance of that portion of the patch 12. Specifically, as shown in FIG. 3B, the portion 12*a* of the carbon nanotube network that is directly above a negatively charged (i.e. negative voltage applied) gate electrode 19 will be in the ON state and conducting while the portion(s) 12*b* of the carbon nanotube network above a positively charged gate electrode 19 will be in the OFF state and will not conduct electrical current. Consequently, the resonant frequency of the patch-antenna 10 can be tined electrically.

The metallic backgate 18 be kept very thin (much less than the skin-depth) in order to avoid absorption or distortion of radio-frequency radiation field between the antenna patch 12 and the ground-plane 24.

Figure 2:
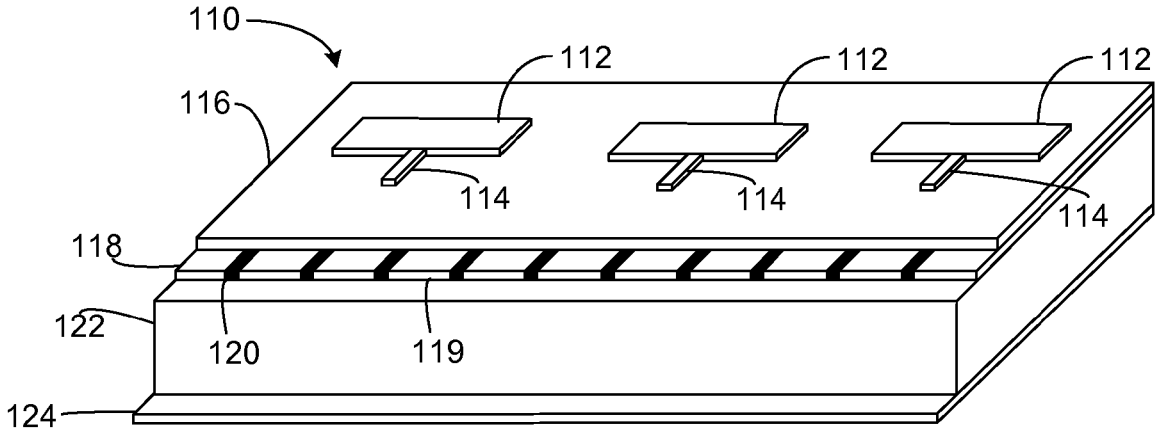
FIG. 2 is a perspective view of device comprising an array of carbon nano-tube based variable frequency patch antennas.

FIG. 2 depicts a patch antenna 110 with an array of carbon nanotube patches 112. The patch antenna 110 preferably comprises an array of carbon nanotube patches 112 with each patch comprising a dense network or thick layer of semiconducting carbon nanotubes grown or deposited on an oxide layer 116. Coupled to each patch 112 and deposited on an oxide layer 116 is a metal microstrip feedline 114. The oxide layer 116 is deposited or grown on a partitioned backgate 118 comprising metal gate electrodes 119 separated by partitions 120 comprising a dielectric or the like. The backgate is deposited or grown on a top side of a substrate 122, such as quartz or the like. A ground-plane 124 formed from a thin layer of metal is coupled to the bottom of the substrate 122.

Figure 4A:
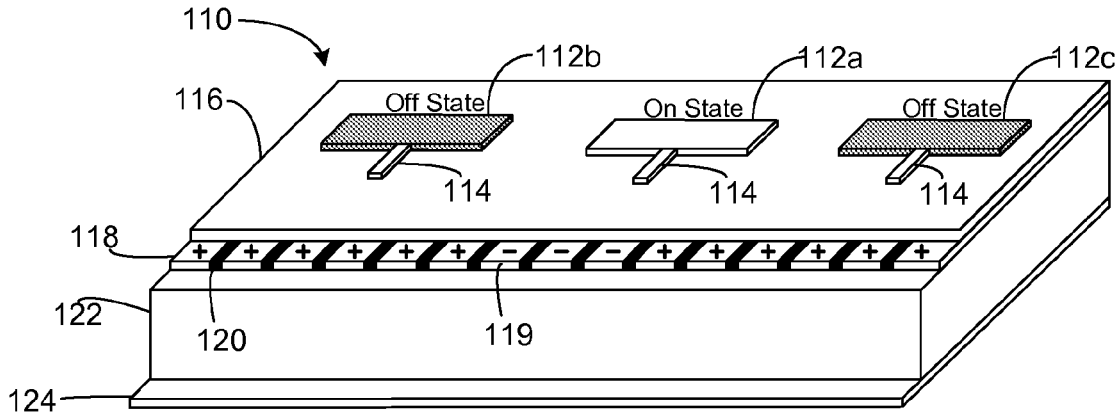
FIGS. 4A and 4B are perspective views of the patch antenna shown in FIG. 2 illustrating the effect altering the bias of the gate electrodes.
Figure 4B:
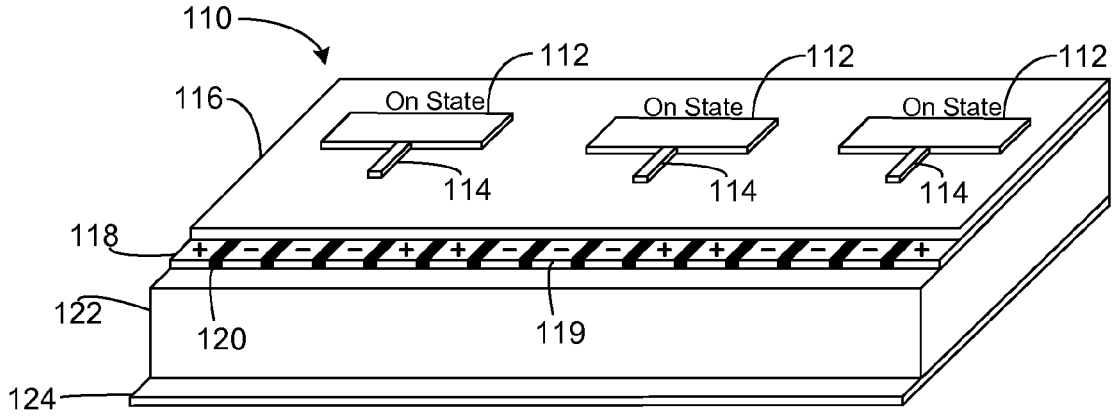
Figure 5:
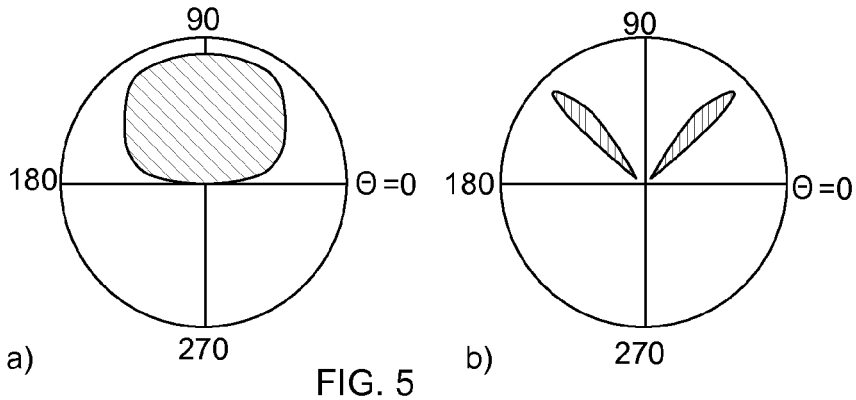
FIG. 5A is a graph illustrating a typical radiation pattern of a patch antenna.
FIG. 5B is a graph illustrating a radiation pattern of a carbon nano-tube based variable frequency patch antennas generated by biasing certain backgates.

The idea of steering a radiation beam is commonly performed using multiple antenna sources and varying the phase of the RF-signal applied to each of them. This way, constructive and destructive interference from the elements in the antenna array will create greater directivity of the transmitted beam. A typical radiation pattern, which is shown in FIG. 5A, can be achieved by biasing the gate electrodes 119, as shown in FIG. 4A, to place the center patch 112*a* of the antenna array in an On State and the outer antennas 112*b* and 112*c* in an Off State. By judiciously biasing certain gate electrodes 119, directional beam-forming can occur, as shown in Figure SB, and can be steered electrically. The radiation pattern shown in FIG. 5B can be achieved by biasing the gate electrodes 119 to place each of the patches 112 in an On State.

In addition to turning ON and OFF various elements in the array to form and steer the RF-radiation beam, one can also use the well known method of varying the phase and amplitude of the RF signal applied to each of the active elements within the array to further augment the beam-forming and steering.

Figure 6:
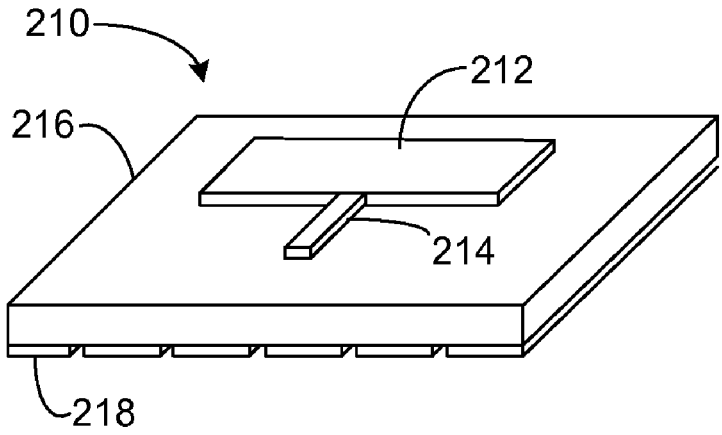
FIG. 6 is a perspective view of an alternative carbon nanotube based variable frequency patch antenna.
Figure 7:
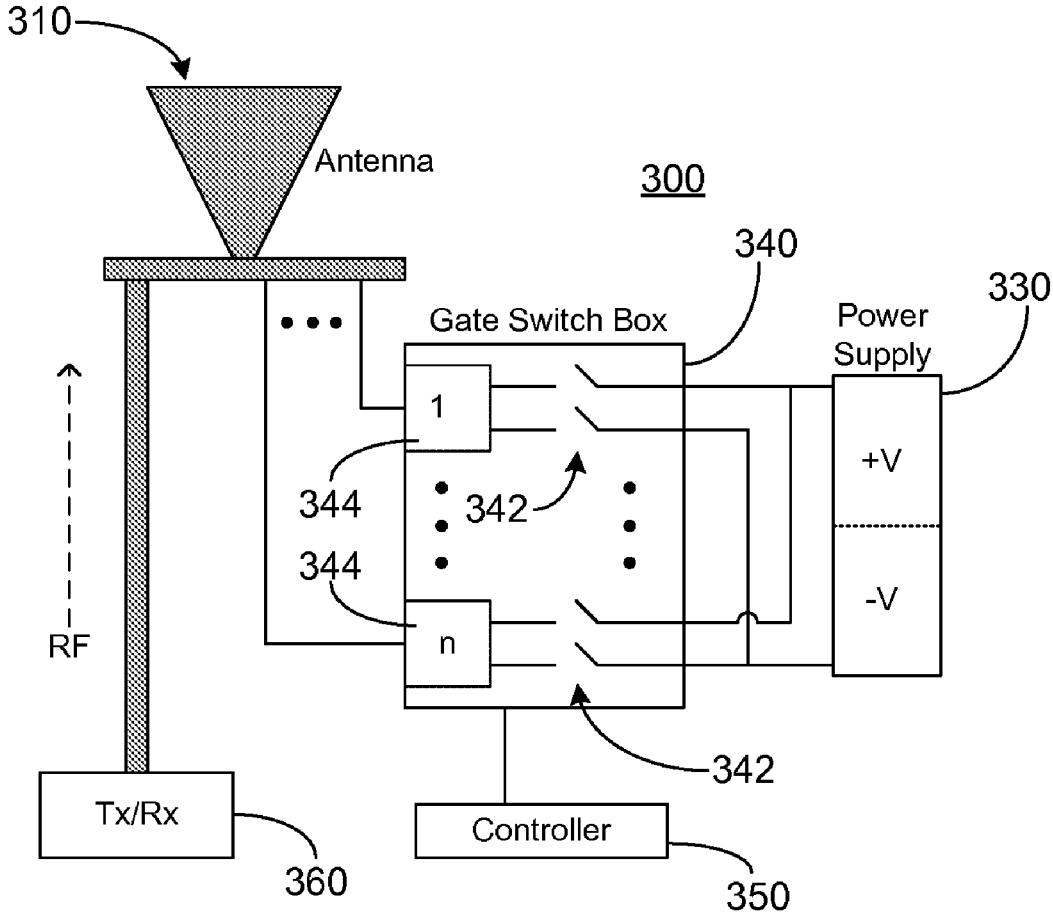
FIG. 7 is a schematic of a system incorporating the patch antennas shown in FIGS. 1 and 2.

If the location of the backgate shown in FIGS. 1, 2, 3A-B and 4A-B are too disruptive to antenna's function, an alternative would be to let the ground-plane double as the backgate as shown in FIG. 6. As depicted, the patch antenna 210 a patch 212 comprising a dense network or thick layer of semiconducting carbon nanotubes grown or deposited on a substrate 216 such as an oxide layer, quartz or the like. Coupled to the patch 212 and deposited on the substrate 216 is a metal microstrip feedline 214. A partitioned dense network or thick layer of semiconducting carbon nanotubes 218 are grown or deposited on a bottom side of the substrate 216 opposite the patch 212. The partitioned layer of carbon nanotubes 218 doubles as a ground plane at RF and apportioned back-gates at DC.

The patch antenna described herein provide the following advantages: 1) the antennas resonant frequency can be electrically controlled by changing the effective size of the carbon nanotube based patch, and 2) an electrically steerable radiation pattern can be achieved by appropriately biasing the back-gate.

The patch antenna would be implemented by either customizing the controls within the intended device or work as an external unit that is capable itself of properly adjusting gate switches to obtain the intended frequency. Preferably, the system or device in which the patch antenna is implement would include a patch antenna 310 coupled to a transmitter/ receiver 360 and a gate switch box 340 comprising a plurality of switch pairs 342 each coupled through a plurality of junctions (1 through n) to a separate gate electrode of a partitioned backgate of the patch antenna 310. A power supply 330 comprising positive and negative voltages sources is coupled to the gate switch box 340. A controller 350 coupled to the gate switch box 340 is used to selectively open and close each of the switches of the plurality of switch pairs 342 to direct positive or negative voltages to each of the gates of the partitioned backgate of the patch antenna 310 to vary the frequency of the antenna and/or to form and steer radiation beams emitted from the antenna.

While the invention is susceptible to various modifications, and alternative forms, specific examples thereof have been shown in the drawings and are herein described in detail. It should be understood, however, that the invention is not to be limited to the particular forms or methods disclosed, but to the contrary, the invention is to cover all modifications, equivalents and alternatives falling within the spirit and scope of the appended claims.

The invention claimed is:

1. A variable frequency patch antenna comprising a patch formed from a dense network of semiconducting carbon nanotubes on a first layer; and a partitioned backgate positioned below the first layer.

2. The antenna of claim 1 wherein the resonant frequency of the antenna is tunable electrically by adjusting appropriate sections of the partitioned backgate.

3. The antenna of claim 1 wherein the effective size of the patch is adjustable by adjusting appropriate sections of the partitioned backgate.

4. The antenna of claim 1 further comprising a second layer positioned below the partitioned backgate.

5. The antenna of claim 4 further comprising a ground plane position below the second layer.

6. The antenna of claim 1 wherein the partitioned back gate is adapted to perform as both a back gate and a ground plane.

7. The antenna of claim 1 wherein the patch includes an array of patches formed on a layer, wherein each patch comprises the dense network of semiconducting carbon nanotubes.

8. The antenna of claim 1 wherein a microstrip feedline is coupled to the patch and the first layer.

9. The antenna of claim 1 wherein the partitioned backgate comprises metal gate electrodes separated by dielectric partitions, wherein the metal gate electrodes can be positively charged or negatively charged.

10. An variable frequency antenna system comprising:

a patch that comprises a dense network or thick layer of semiconducting carbon nanotubes;

a partitioned backgate coupled positioned below the patch, wherein the partitioned backgate comprises metal gate electrodes separated by dielectric partitions;

a gate switch box coupled to the partitioned back gate;

a power supply coupled to the gate switch box;

a controller coupled to the switch box adapted to selectively gate one or more portions of the partitioned backgate.

11. The system of claim 10, further comprising a transmitter, a receiver, or transceiver coupled to the patch.

12. The system of claim 10, wherein the power supply comprises positive and negative voltage sources.

13. The system of claim 10, wherein the partitioned backgate is adapted to perform as both a backgate and a ground plane.

* * * * *